US010143299B1

(12) United States Patent
Hafner et al.

(10) Patent No.: US 10,143,299 B1
(45) Date of Patent: Dec. 4, 2018

(54) CLOSET ADD-ON ARMOIRE CONVERSION SYSTEM

(71) Applicants: Daniel F. Hafner, Ft. Lauderdale, FL (US); Elisabeth A. LeQuin, Trabuco Canyon, CA (US)

(72) Inventors: Daniel F. Hafner, Ft. Lauderdale, FL (US); Elisabeth A. LeQuin, Trabuco Canyon, CA (US)

( * ) Notice: Subject to any disclaimer, the term of this patent is extended or adjusted under 35 U.S.C. 154(b) by 0 days.

(21) Appl. No.: 15/601,731

(22) Filed: May 22, 2017

(51) Int. Cl.

| | |
|---|---|
| ***A47B 67/02*** | (2006.01) |
| ***A47B 47/00*** | (2006.01) |
| ***A47B 61/00*** | (2006.01) |
| ***A47B 88/40*** | (2017.01) |
| ***A47B 91/06*** | (2006.01) |
| ***A47B 96/06*** | (2006.01) |
| ***A47B 57/26*** | (2006.01) |
| ***A47B 97/00*** | (2006.01) |

(52) U.S. Cl.
CPC ..... *A47B 47/0091* (2013.01); *A47B 57/26* (2013.01); *A47B 61/00* (2013.01); *A47B 88/40* (2017.01); *A47B 91/06* (2013.01); *A47B 96/06* (2013.01); *A47B 97/00* (2013.01); *A47B 2088/401* (2017.01)

(58) Field of Classification Search
CPC ..... A47B 47/0091; A47B 88/40; A47B 57/26; A47B 61/00; A47B 91/06; A47B 96/06; A47B 67/00; A47B 2088/401; E06B 7/34
USPC ..... 312/242, 204, 198–203
See application file for complete search history.

(56) References Cited

U.S. PATENT DOCUMENTS

| | | | | | |
|---|---|---|---|---|---|
| 1,975,779 | A * | 10/1934 | Church | A47B 61/00 | 312/296 |
| 3,165,368 | A * | 1/1965 | Hughes | A47B 61/00 | 108/149 |
| 4,095,860 | A * | 6/1978 | Henson | A47B 97/00 | 312/199 |
| 5,707,125 | A * | 1/1998 | Coglin | A47B 95/008 | 312/242 |
| 6,457,278 | B1 * | 10/2002 | Fleming | A47B 46/00 | 312/249.7 |
| 6,634,727 | B2 * | 10/2003 | Torres | E06B 7/34 | 312/321.5 |
| 7,216,412 | B2 * | 5/2007 | Vance | A47B 61/02 | 29/401.1 |
| 2008/0079338 | A1 * | 4/2008 | Van Dyke | A47B 53/02 | 312/201 |

(Continued)

*Primary Examiner* — Daniel J Troy
*Assistant Examiner* — Timothy M Ayres
(74) *Attorney, Agent, or Firm* — Jonathan A. Kidney; CKR Law LLP

(57) ABSTRACT

A closet door-to armoire conversion has a panel with the depth being at least six inches, height being greater than a height of the closet entrance. A plurality of shelf mounting holes is disposed on lateral sides of the panel. At least a shelf and a hanging rod is interior to the panel. Rollers are attached to the panel bottom, supporting and permitting rolling of the panel(s) from the closet entrance. A handle or gripping area is on the front face of a panel and a plurality of hinges are attached to the interior side of the closet armoire and to the closet door jam side. The hinges allow an attached panel to move away from and pivot from the same side of the closet entrance, wherein the width and height of the closet armoire is wider and taller than the closet entrance so as to cover the closet entrance.

11 Claims, 15 Drawing Sheets

(56) References Cited

U.S. PATENT DOCUMENTS

2016/0166057 A1* 6/2016 Hubert ..... B25H 1/04
312/237

* cited by examiner

700

CLOSET ADD-ON ARMOIRE CONVERSION SYSTEM

FIELD

This invention relates to closeting systems. More particularly, it relates to an elegant closet conversion system to provide a combination armoire/closet.

BACKGROUND

The common complaint for most home owners/tenants is that there is insufficient closet space. Options are to either to remodel the existing closet (very expensive) or add a free standing cabinet or shelving system, which is placed or attached to an exposed wall space. Of course, if wall space is limited or if the room is small, then there are no viable options for increasing closet or storage space.

Accordingly, there has been a long-standing need for a system and/or method that allows for closet/storage space to be increased without renovation. Various designs for a closet storage door are elucidated below, adding the much needed "space" while maintaining the functionality of the existing closet.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a system for increasing closet space by replacing a closet door with a closet armoire is provided, the closet armoire comprising: at least one armoire panel having a depth, height and width, the panel depth being at least six inches, the panel height being greater than a height of a closet entrance; a plurality of shelf mounting holes disposed on lateral sides of the panel; at least one of a shelf and a hanging rod disposed on an interior closet side of the panel; rollers attached to a bottom portion of the at least one armoire panels, supporting it and permitting rolling of the panel(s) from a face of the closet entrance; at least one of a handle and gripping area disposed on a front face of the at least one panel; and a plurality of hinges attached to an interior side of the closet armoire and to a door jam side of the closet entrance, the hinges configured to allow an attached panel to move away from and pivot from the same side of the closet entrance, wherein the width and height of the closet armoire is wider and taller than the closet entrance so as to cover the closet entrance.

In another aspect of the disclosed embodiments, the above system is described, wherein the closet armoire comprises two adjoining side-by-side panels, hinged at their junction so as to operate as a bi-fold door when the closet armoire is opened or closed; and/or wherein a height of the closet armoire extends beyond the height of the closet entrance, and wherein a storage area is disposed in the extended portion of the closet armoire; and/or further comprising shelving disposed on the front face of the at least one panel; and/or wherein the hinges are at least triple-hinged, comprising: a rear portion with mounting holes for attaching the rear portion to the door jam, a forward portion with mounting holes for attaching the forward portion to the panel, and a non-attached mid-portion, wherein multiple hinging operates to permit a rear edge of the panel, attached to the door jam, to move away from the door jam without pinching the door jam, when the panel is pulled open; and/or wherein the hinges are a combination sliding-pivoting hinge, comprising: a substantially rectangular, hinge-holding, hollow sleeve with a panel-side opening and at least two mounting holes through opposing lateral sides of the sleeve and a retaining hole through one of the opposing lateral sides of the sleeve, wherein the mounting holes enable door jam screws to be mounted therein to retain the hollow sleeve to the door jam and the retaining hole enables a removable retaining pin or screw to be fixed therein; and a hinge with a forward portion with mounting holes for attachment to the panel and a rear portion with a substantially longitudinal opening accommodating placement of the door jam screws therein, wherein placement of the rear portion of the hinge into the hollow sleeve and with insertion of the removable retaining pin or screw into the retaining hole, permits limited sliding of the hinge into and out of the hollow sleeve; and/or further comprising a spring, wherein the spring is attached to a closet-side end of the rear portion of the hinge and to a closet-side end of the hollow sleeve; and/or further comprising at least one of a sliding basket and drawer disposed on the shelf within the at least one panel; and/or wherein the at least one shelf and sliding basket further comprises springed mounting protrusions at ends thereof for insertion into the shelf mounting holes; and/or further comprising modified shelving holes in sides of the at least one panel, wherein the modified shelving holes are shaped with an interior upper surface that opens upwardly and to a face of the hole, so as to allow a mounting protrusion from a shelf or basket to slide into and be pushed down to a terminal point of the modified shelving holes; and/or further comprising a shelf-to-shelf mounting hole member, comprising: a substantially cylindrical insert with a hollow end, configured to fit into a shelf mounting hole; an extension arm, one end coupled to at least one of an upper and lower portion of the insert; and at least one of a shelf, drawer, rod, and basket coupled to an other end of the extension arm, wherein the hollow end of the insert is sized to accommodate a mounting protrusion for another shelf, drawer, rod, or basket, wherein the shelf-to-shelf mounting hole member permits a single shelf mounting hole to support a plurality of shelves, drawers, rods, or baskets; and/or further comprising a door on a face of the at least one panel, the door providing access to items stored within a panel.

DETAILED DESCRIPTION

If a homeowner or renter is desirous of increasing their storage space, for example, in a bedroom, they typically rely on either installing shelves in the back walls of the closet or adding shelving to the room walls. These approaches require significant handyman skills as well as "damages" the walls (a concern for landlords who may not want the modifications after the tenant leaves). As described below, a modified closet storage door is devised that is placed over the closet entrance, replacing the closet door, but having, in various embodiments, combinations of the desired shelving, racks, drawers, etc. The modified closet storage door functions in many ways as an armoire in that it has a front face that can provide the desired privacy of a closet while facilitating storage of clothing and other goods. Additionally, since the added space provided by the modified closet storage door (hereafter referred to as "closet armoire," for ease of reference) is at the closet's location, the occupant's items can be located at one place, rather than being spread across other parts of the room (e.g., closet and a shelf on remote wall or cabinet). Thus, unlike a typical separate armoire, all clothes can be situated in a single area, without utilizing additional wall space. Further, as will be apparent below, the user can view his/her entire wardrobe with the exemplary system, if so desired.

As the closet armoire is opened/closed to access the stored items, some mechanism for rolling, sliding, etc. is provided at the bottom of the closet armoire to allow it to roll/slide along the floor with relative ease. In some embodiments, the closet armoire may be solely attached to the closet casing or door jam and not require any bottom rolling/sliding support. In some embodiments, a lock or other mechanism can be provided to secure the closet/closet armoire. In various embodiments, depending on the number of rollers, materials used, etc., the closet armoire may support up to and beyond 250 lbs.

Figure 1A:
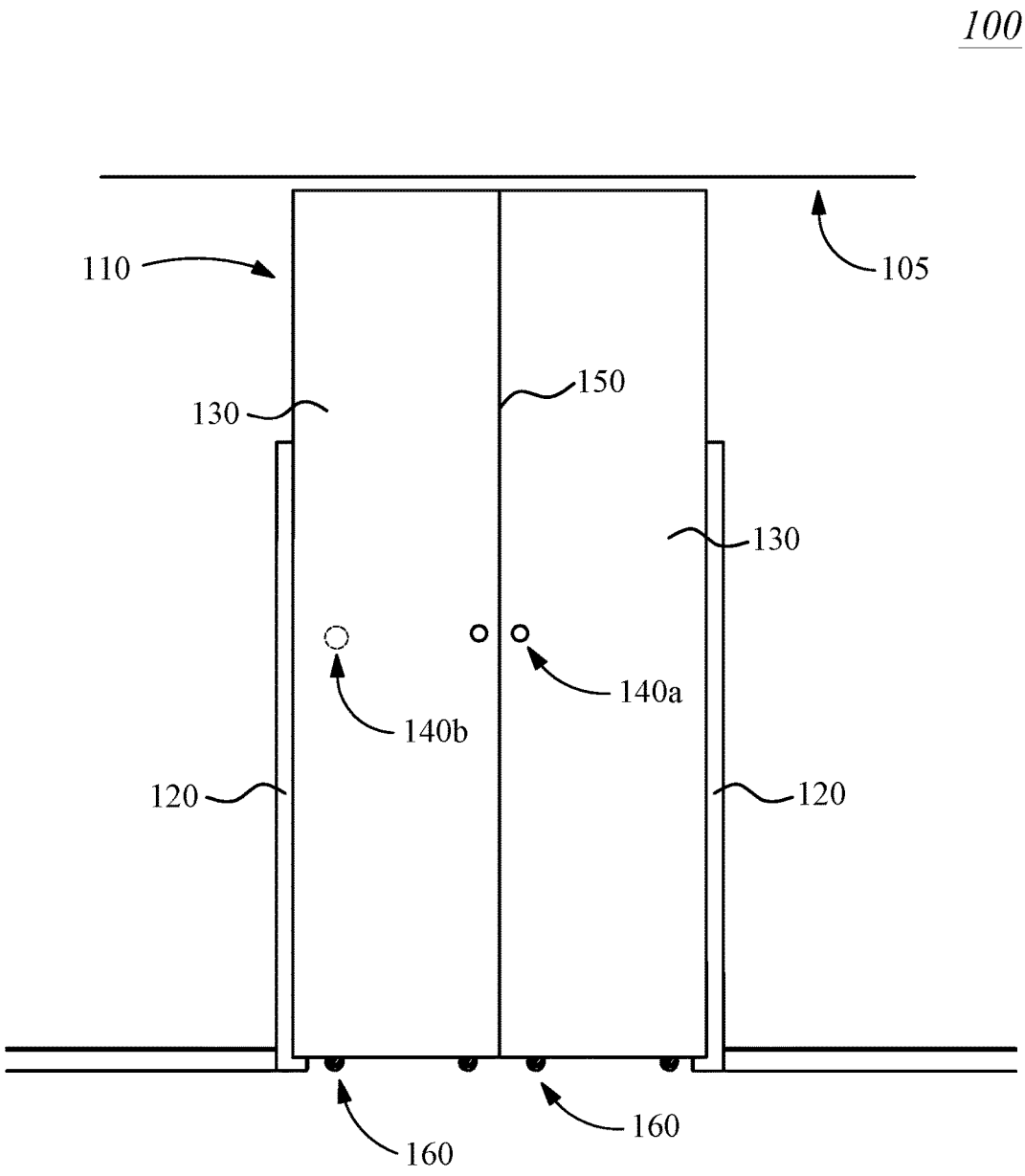
FIG. 1A is an illustration of a front of one embodiment of a closet armoire mounted to a closet door jam.

FIG. 1A is an illustration 100 of a front of one embodiment of a closet armoire 110 mounted to a closet door jam or casing 120. The front of the closet armoire 110 can be one or more panels 130 with knobs 140*a* (optional knob 140*b*) or other gripping mechanism (e.g., cavity in the face of the closet armoire 110, etc.) to open/close the closet armoire 110. The knob(s) 140*a,b* can be placed at any location on the panel(s) 130. If a plurality of panels 130 are used (shown here as two panels), they can be vertically joined 150 and pivot open while being supported by any one or more of casters, rollers, glides, etc. 160 at the bottom of the closet armoire 110. In some embodiments, the casters, rollers, glides, etc. may not be necessary if the closet armoire 110 is sufficiently supported by its attachment mechanism (not shown) to the closet casing 120, so as to allow it to hang. In lighter/smaller embodiments, this may be a viable option. Therefore, while the embodiments herein illustrate the use of a caster, roller, glide, etc., it is expressly understood that various embodiments may not require such additional support. Continuing, the pivoting of joined panels 130 can be achieved by any commonly known pivoting/hinging system known in the art. The panels 130 can be of unequal size, if so desired. Moreover, while multiple panels 130 are shown, it is possible to have a single panel, which contains the armoire features described herein, according to design preference.

It should be appreciated that the panel(s) are understood as enclosures to the front of the closet, but with sufficient height and width to cover the closet opening—that is, the panels operate as a proxy to the original closet door. However, the panels are also of sufficient depth to accommodate shelving, clothing/hanging rods, drawers, etc., to also operate as a storage space. Thus, the panel(s) provide dual functions, as a "door" to the closet and as a storage area that is accessible when opened, like a door. The panels can be wide enough to cover a typical closet entry ways, sized to match a 24", 30", or 36" wide closet, and so forth. The panels can be at least 6 inches and up to 2 feet in depth, if so desired. Of course, other sizes are available and the examples above are understood as illustrative and not limiting.

One or more lateral sides of the closet armoire 110 face is attached to the closet casing 120, typically, but not necessarily to the pre-existing closet door hinges. That is, the user can remove the pre-existing closet door while leaving the closet door hinges affixed to the casing 120. And then attach a predetermined side of closet armoire 110 to the closet door hinges. To assist in facilitating this, the closet armoire 110 can have pre-designated hinge mounting points/cut-outs on one or more of its sides for easy attachment of the closet door hinges (not shown). It should be evident this approach avoids having to remove the closet hinges and only requires the very simple mounting of the closet hinges to the closet armoire 110, while avoiding any damage to the casing 120.

In other embodiments, the original closet hinge may be too wide or not suitable and therefore a closet armoire hinge is provided for the closet armoire 110 and then attached to the casing 120, rather than vice versus. The closet armoire 110 may come preconfigured with such a hinge, if so desired. In either of the above scenarios, the hope is to avoid any damage to the closet casing 110, specifically the outside the hinge cut-outs when attaching a hinged side of the closet armoire 110 to the casing 120. However, in some instances, it may be necessary to drill new hinge mounting holes into the casing 120, or lesser so to the hinge cut-outs in the casing 120. This may be necessitated by the fact the pre-existing closet door's hinge mount holes in the casing 120 may not match with the closet armoire 110 hinges and new screw holes may be required.

It should be appreciated that the closet armoire 110 can be designed to fit over the "front" face of the casing 110 or, in another embodiment, fit against the interior "side" of the casing 110. That is, in some embodiments, the closet armoire 110 can be larger than the closet door (over the casing's front face) or of the same size (against the casing's interior side) as the closet door. Therefore, variations and modifications to the size of the closet armoire 110 and associated mounting mechanisms thereof are understood to be within the purview of one of ordinary skill in the art and within the scope of this disclosure. For example, FIG. 1A shows the closet armoire 110 wider than the interior edge of the closet casing 120. Further, FIG. 1A shows the closet armoire 110 extending vertically higher (significantly) that the top of the closet (providing additional storage space "above" the closet entrance).

Figure 1B:
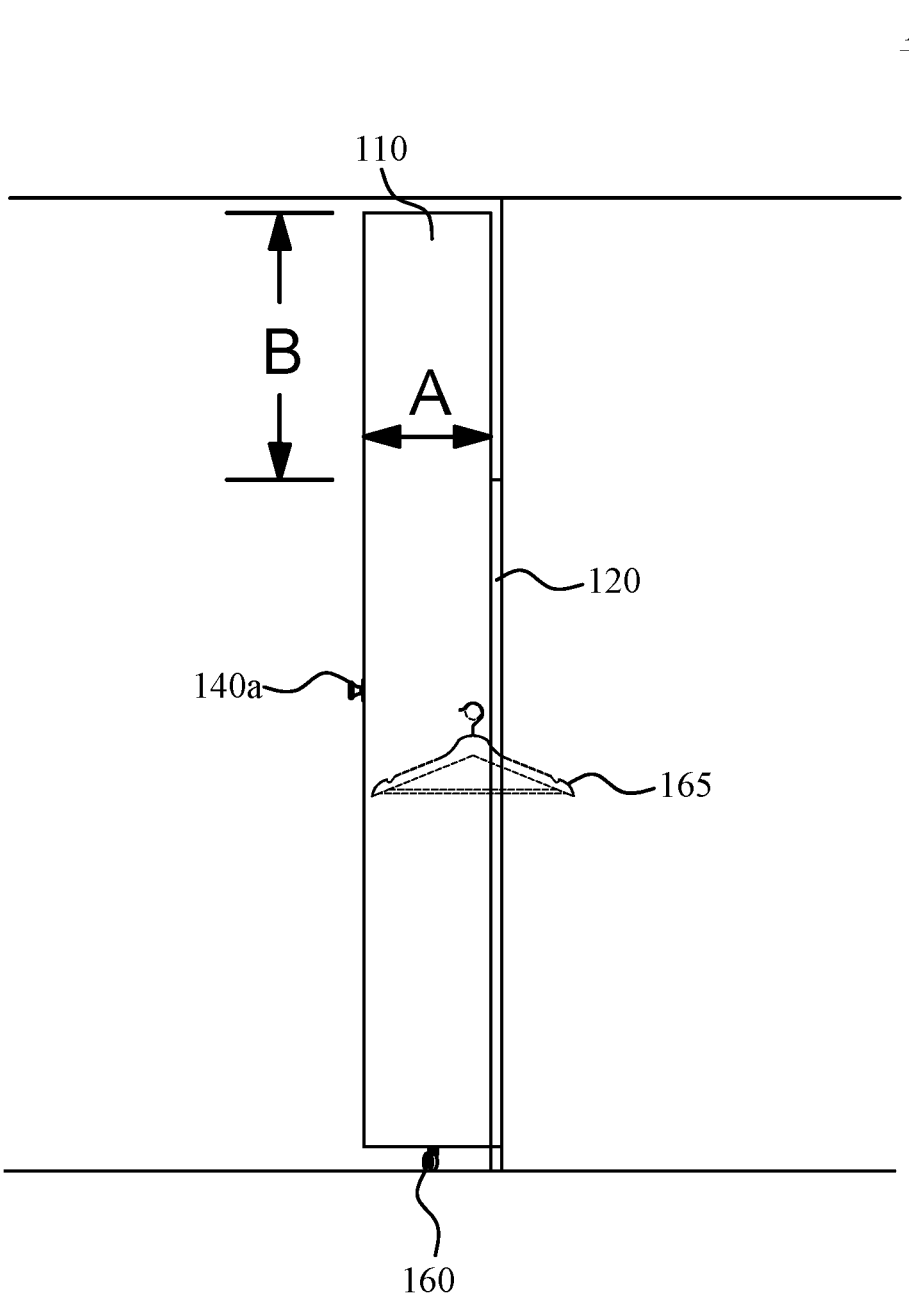
FIG. 1B is a cross sectional side view of an exemplary closet armoire, showing added A×B dimensioned space.

FIG. 1B is a cross sectional side view 180 of an exemplary closet armoire 110, showing the added A×B dimensioned space. It should be appreciated that the dimension B can represent several feet and rise up to the ceiling, if so desired. Dimension A can be anywhere from several inches to a foot or more and, therefore, since the closet door has been removed, allows hanger 165 to be hung in the closet armoire 110, with a portion of the hanger 165 easily extending into the closet space. It should be appreciated that the exemplary closet armoire 110's upper extension may not need to be as exactly as shown. For example, drawers, shelves, etc. that are exposed to the interior of the room (versus the interior of the closet) can be implemented, as well as a different shape for the top section of the closet armoire 110. For example, the top of the closet armoire 110 can have an arc-like shape, for aesthetic purposes. Accordingly, various shapes, orientations, modifications and changes to the closet armoire 110 are understood to be within the purview of one of ordinary skill in the art, and are understood to be within the scope and spirit of this disclosure.

Figure 2A:
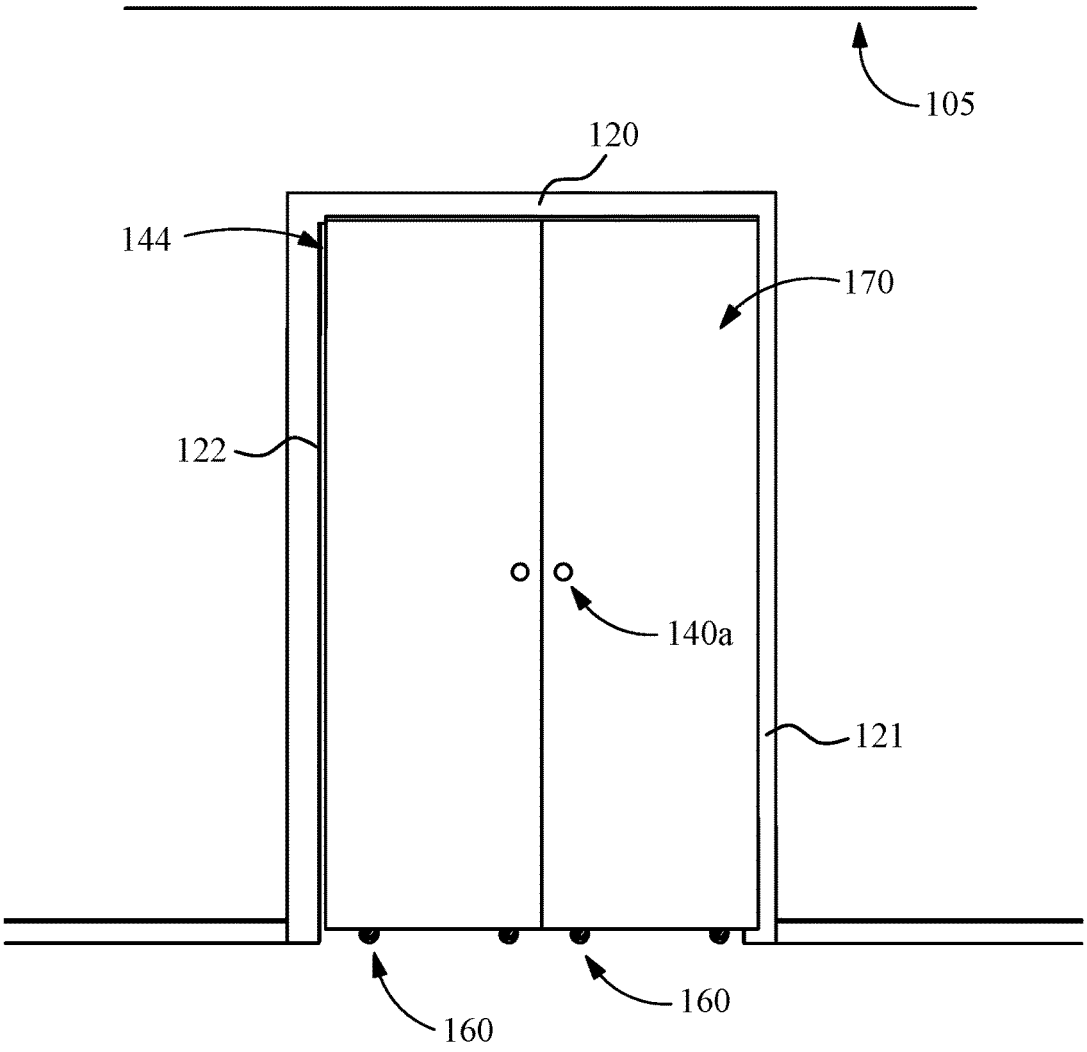
FIG. 2A is another exemplary closet armoire.

FIG. 2A is another exemplary closet armoire 170, wherein the height is not near the ceiling 105, but at the top of the casing 120. In this embodiment, the configuration is such that one side (right, for example) borders over the edge of the right casing 121, while borders under the edge of the left casing 122. The "gap" between the closet armoire 170 and the left casing 122 is seen as 144. This embodiment illustrates that the exemplary closet armoire can be situated with respect to the closet casing in various configurations, either with a gap (smaller than casing) or without a gap (wider than casing). Thus, depending on which configuration the user desires to purchase or use, a gapped side or no-gap sides (seen in FIG. 1A) can be facilitated.

Figure 2B:
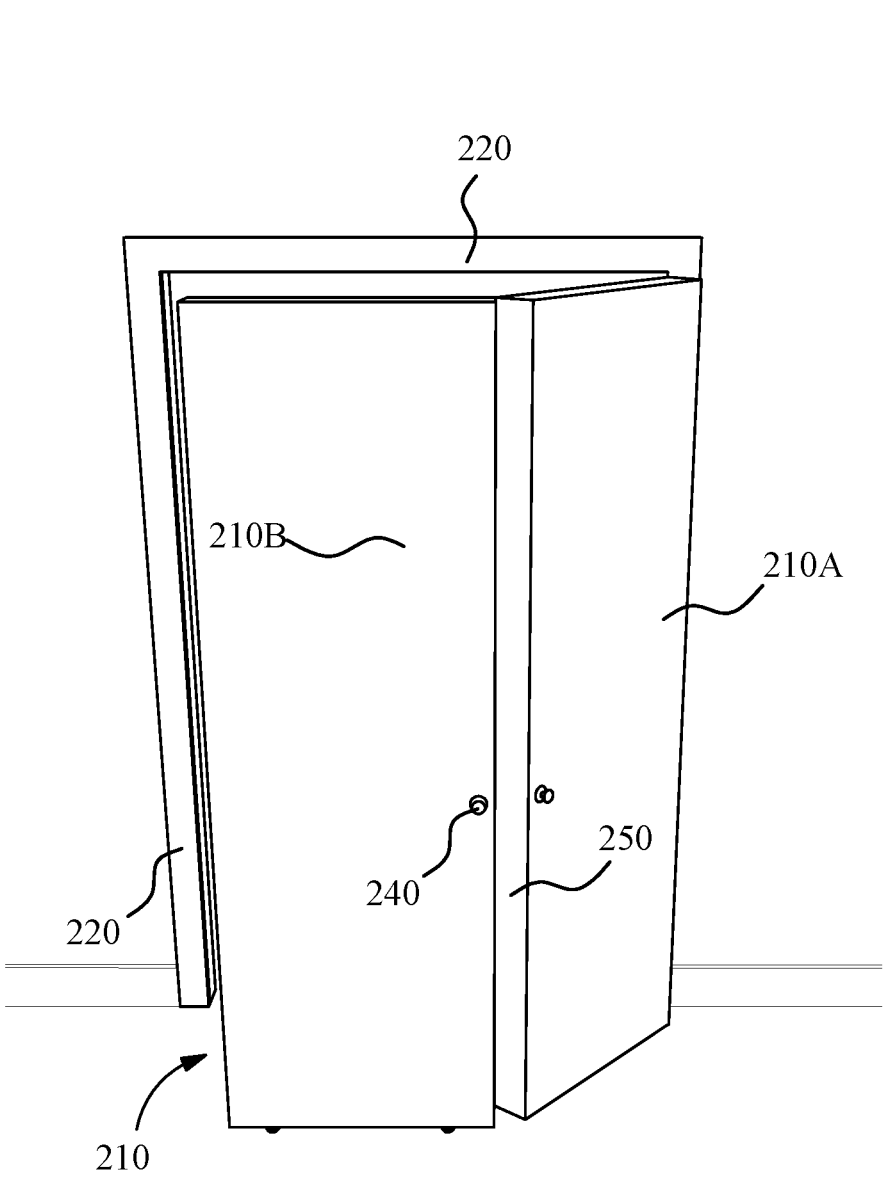
FIG. 2B is an illustration of an exemplary closet armoire partially opened.

FIG. 2B is an illustration 200 of an exemplary closet armoire partially opened. Closet armoire 210 covers a face of the closet casing 220. Here, handles 240 are provided on the front of the panels. It should be understood that while handles 240 are illustrated, any appropriate way of grasping the closet armoire 210 can be used, for example, an inner cutout, etc. A wall thickness of the closet armoire 210 is evident in vertical wall 250 of panel 210A, which is hinged or attached to a neighboring wall (not shown) from adjacent panel 210B. Wall 250 contains, according to design preference, any one or more of shelves, drawers, hanging rod, baskets, shoe racks etc. that are disposed in the closet armoire 210.

Figure 3A:
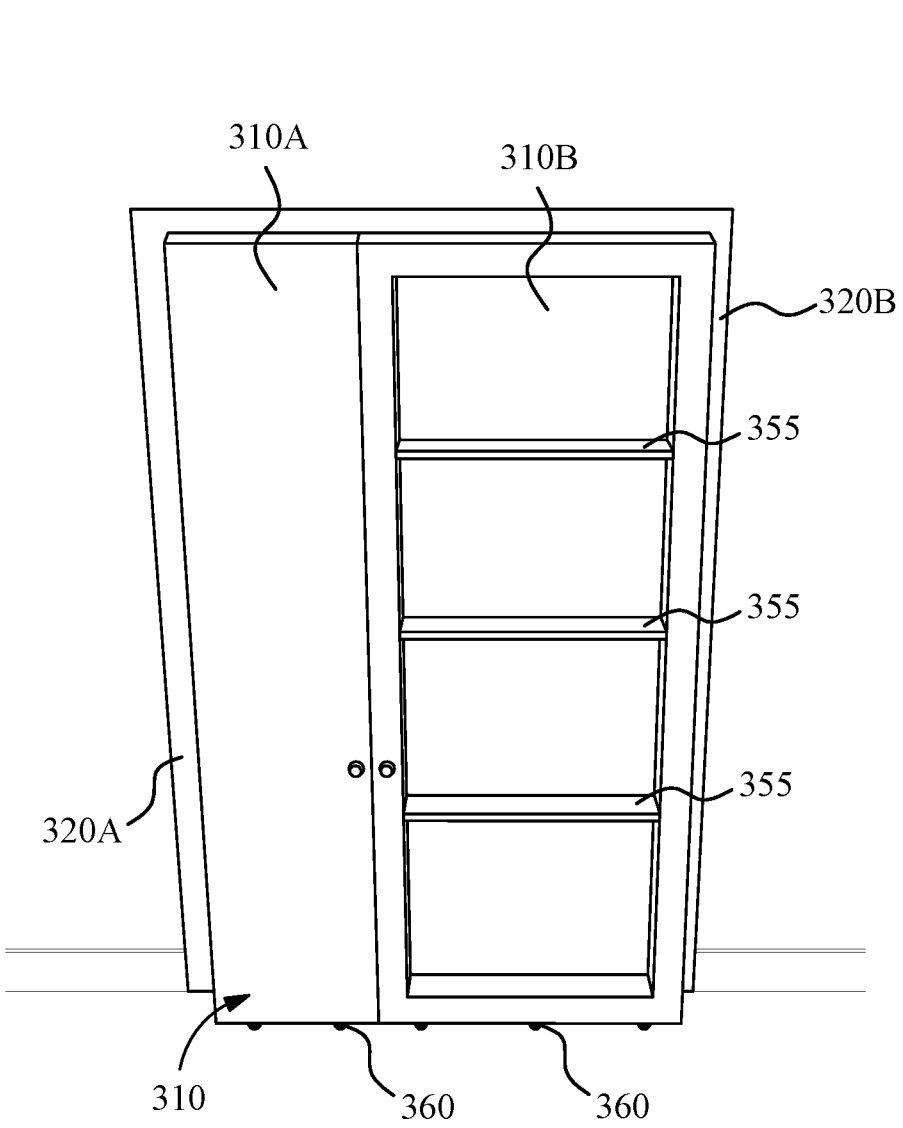
FIG. 3A is an illustration of an embodiment of an exemplary closet armoire with front-exposed shelving.

FIG. 3A is an illustration 300 of another embodiment of a closet armoire 310, having exposed shelving 355 in a front of panel 310B, and adjacent to panel 310A, supported by rollers or wheels 360. This embodiment contemplates a design where panels 310A and 310B are not hinged together but each open up as independent doors. Thus, panel 310A can be mounted and hinged to the left casing 320 and panel 310B can be mounted and hinged to the right casing 320. While FIG. 3A illustrates panel 310A as smaller than the width of panel 310B, it may be the same or larger width, according to design preference. Of course, left panel 310A may have interior shelving, drawers, etc. that are not viewable from the outside.

It should be understood that while FIG. 3A is described as illustrating an embodiment with separately opening panels (310A & 310B), both panels may be joined as seen in FIG. 2B, to allow the panels to operate as a "bi-fold door," opening jointly when one of the opposing panels is opened.

Figure 3B:
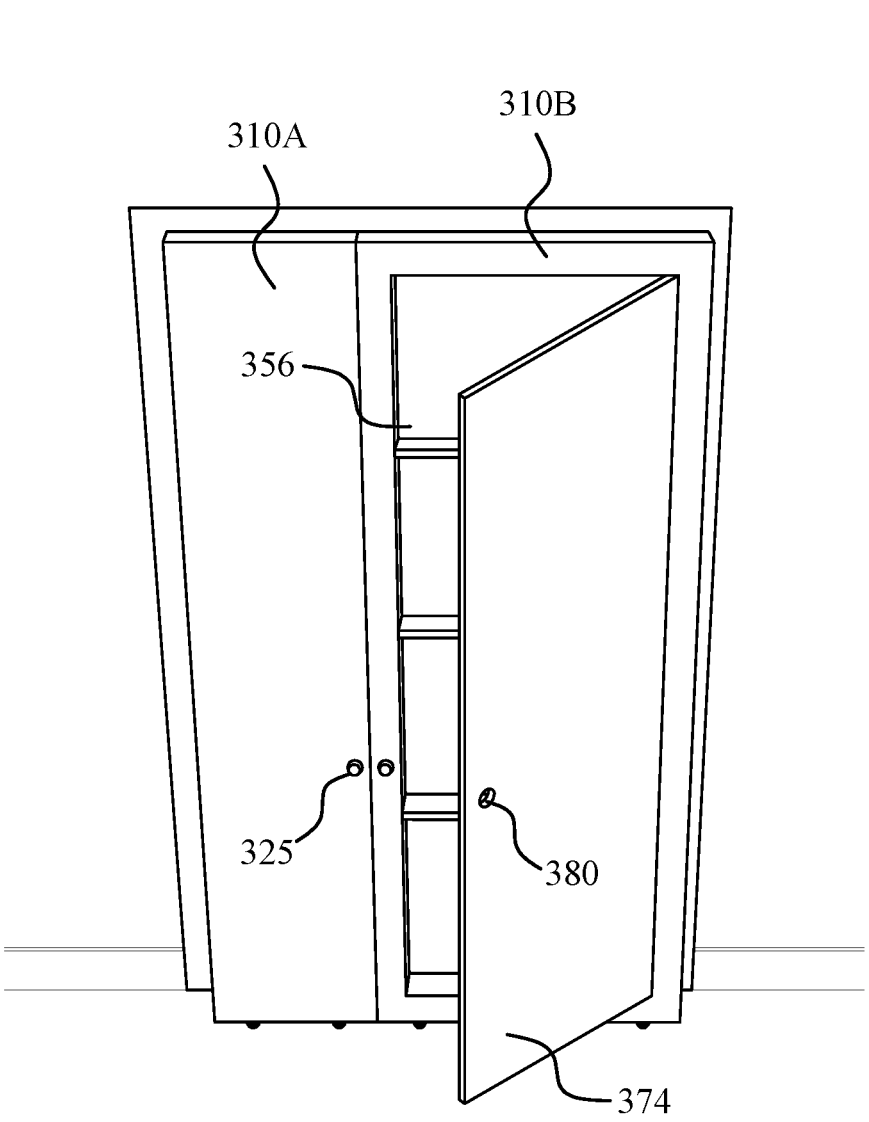
FIG. 3B is an illustration of another embodiment of an exemplary closet armoire with a front door.

FIG. 3B is an illustration 370 of another embodiment of an exemplary closet armoire with a front door 374. This embodiment shows another optional element in that one or more of the front panels (310A/B) of the closet armoire can be a door that opens to reveal an interior of the closet armoire. For example, in this Fig., the right panel 310B is a door 374 with handle or gripping element 380. The door 374 can be held closed when flush with the panel 310B via any one or more latching or securing mechanisms, such as a magnet, latch, friction bearing, spring and so forth. In some embodiments, the handle 380 is optional wherein the door 374 can be spring opened when a face of it is pushed inward and closed in a similar manner, to release or capture the door 374. Further, is it contemplated that the handle 380 can actually be a hole in the door 380 wherein the panel's handle 325 fits through the hole so that a user can grasp the handle 325 to open the closet armoire or "push/pull" against the door 374 for the door 374 to open. As should be apparent, various different methods, systems, devices for door securing are well known in the art, being within the scope of one of ordinary skill in the art and therefore further elaboration is not provided.

Additionally, while FIG. 3B shows the right panel 310B with the door 374, the left panel 310A may be similarly configured with a door. The ability to open the closet armoire without actually having to swing the entire system open, allows a person to easily retrieve an item stored directly in the face of the panels. The use of a door keeps the contents stored in the panels private and also adds to the aesthetics of the closet armoire. It should be further apparent that the door 374 can be a partial door, opening to reveal an upper section or lower section, depending on design preference. Further, the door 374 can be non-solid, that is, a folding/accordion door that acts as a sliding screen to expose the interior of the respective panel.

Figure 4:
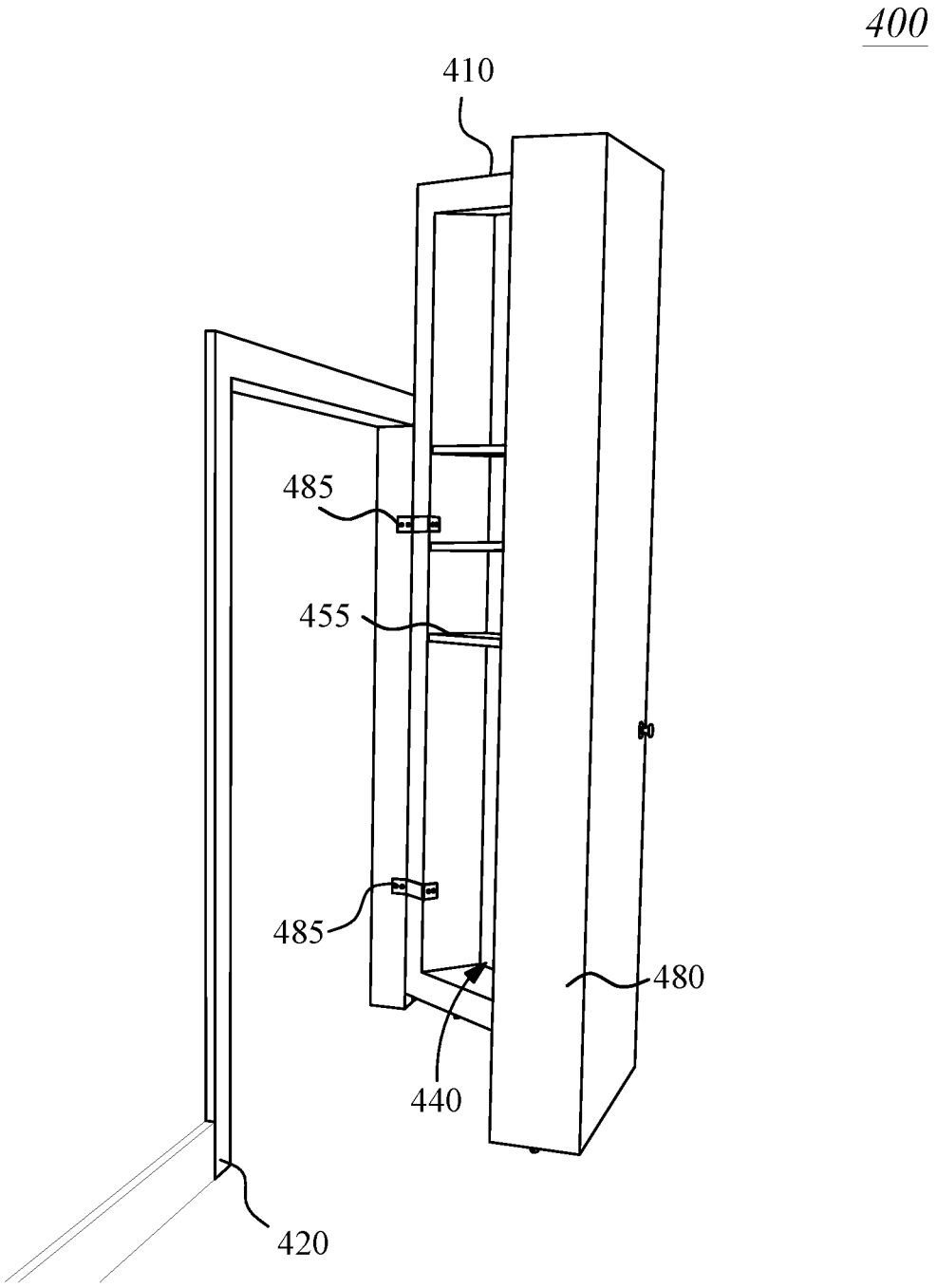
FIG. 4 is an illustration of another embodiment of a closet armoire showing interior shelving.

FIG. 4 is an illustration 400 of another embodiment of a closet armoire 410 showing interior shelving 455 in a cavity 440 from one of the panels. A side width 480 is illustrated to demonstrate a possible "thickness" or depth of the closet armoire 410. Of course, the depth 480 is only illustrative and not to scale. Therefore, actual embodiments may have a greater or smaller side depth 480 than shown. Closet armoire 410 is shown attached to casing 420 via hinges 485. More or less hinges 485 may be utilized, according to design preference.

Figure 5A:
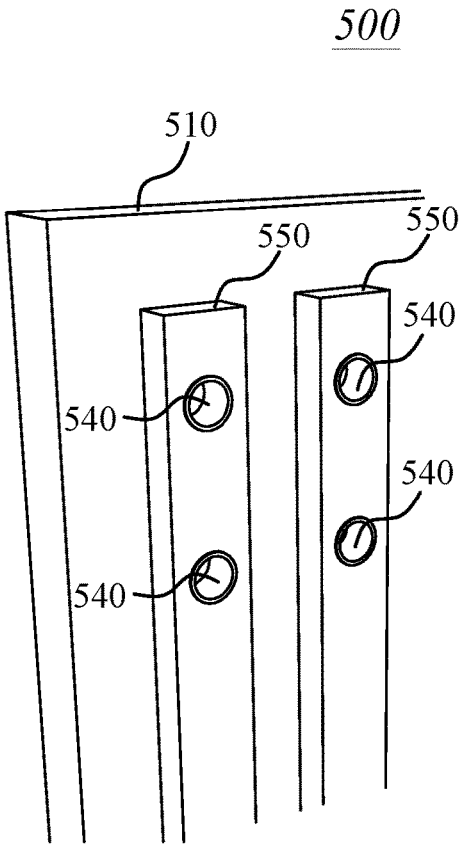
FIG. 5A is an illustration of a possible hole mechanism for attaching shelving, rods, support structures to an interior of an exemplary closet armoire.

FIG. 5A is an illustration 500 of a possible hole mechanism 540 for attaching shelving, rods, support structures to an interior of a panel 510 of an exemplary closet armoire. Here, optional support strips 550 are punctuated with appropriately sized holes 540 that have a circular edge or a tapered upper edge (see FIG. 5B), for easy fitment and release of shelving, rods, support structures, etc. The holes 540 may be covered with a metal or non-wood sleeve (not-shown) to prevent damage to the holes 540 when shelves, etc. are mounted to the holes 540.

Figure 5B:
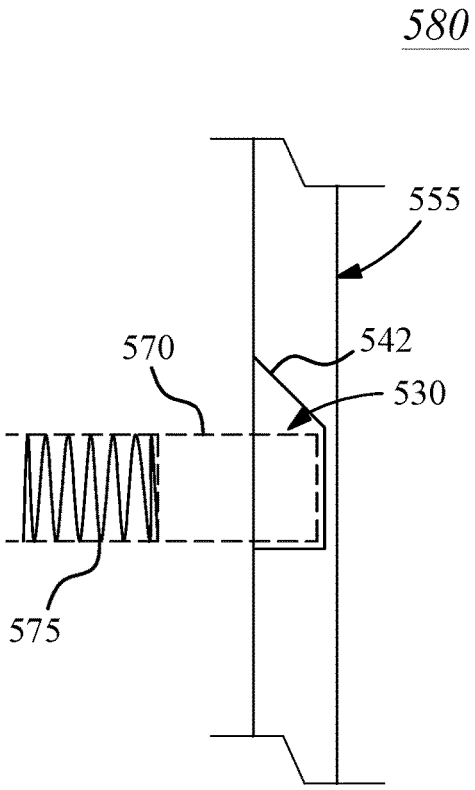
FIG. 5B is a side cut-away illustration of a hole in support strip.

FIG. 5B is a side cut-away illustration 580 of a modified shelf supporting hole 530 in support strip 555 with an upper surface 542 altered to form a tapered enlarged edge of hole 530. The tapering of the upper side 542 of the hole 530 allows a springed pin 570 to be easily inserted and guided down into the terminal end of the hole 530. It also allows the easy removal of the springed pin 570, but simply lifting and pivoting it upward. Springed pin 570 "fits" into the bottom of hole 530 and can be removably inserted via tension formed from internal spring 575. Aspects of springed pins 570 (using a spring 575 or other similar functioning mechanism) are understood to be within the purview of one of ordinary skill in the art and therefore additional details on various modifications, changes and so forth are within the spirit ad scope of this disclosure.

Figure 6A:
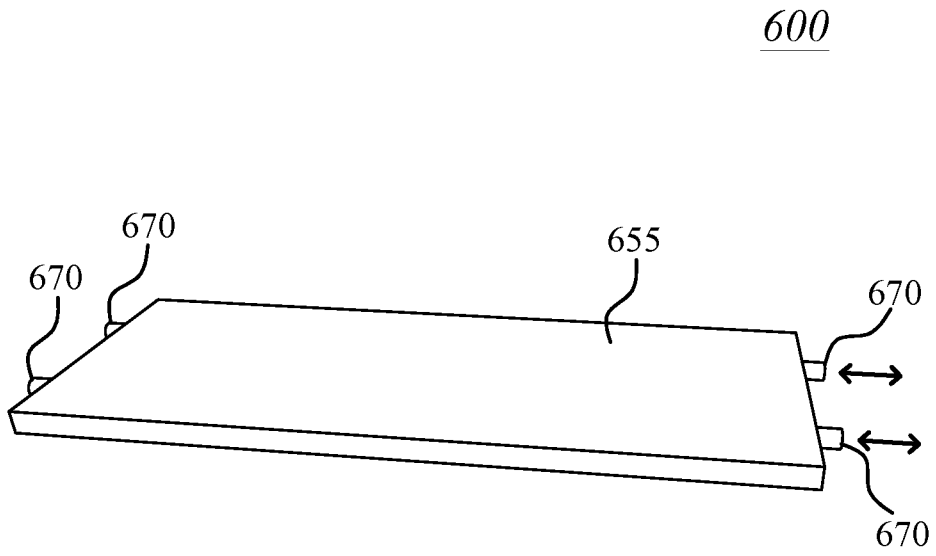
FIG. 6A is a perspective view of a shelf utilizing springed pins.

FIG. 6A is a perspective view 600 of an exemplary shelf 655 utilizing springed protrusions or pins 670, designed to be removably inserted in the holes 540 of FIGS. 5A, B. It is understood that only some or all of the pins 670 may be springed, according to design preference. FIG. 6A should be self-explanatory.

Figure 6B:
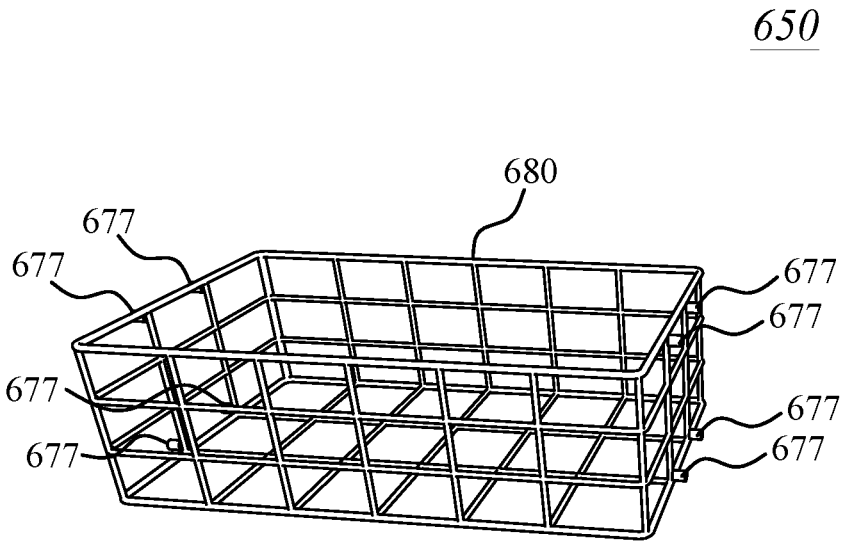
FIG. 6B is a perspective view of a wire basket utilizing springed pins.

FIG. 6B is a perspective view 650 of a wire basket 680 with springed pins 677, designed to be removably inserted in the holes 540 of FIGS. 5A, B. It is understood that FIG. 6B is self-explanatory. It should be noted that in some embodiments, not all of the pins 670, 677 shown in FIGS. 6A, B are necessarily springed, as only one side of the shelf 655 or basket 680 can be fitted with springed pins 670, 677 to allow fitment in the holes of a closet armoire.

Figure 7:
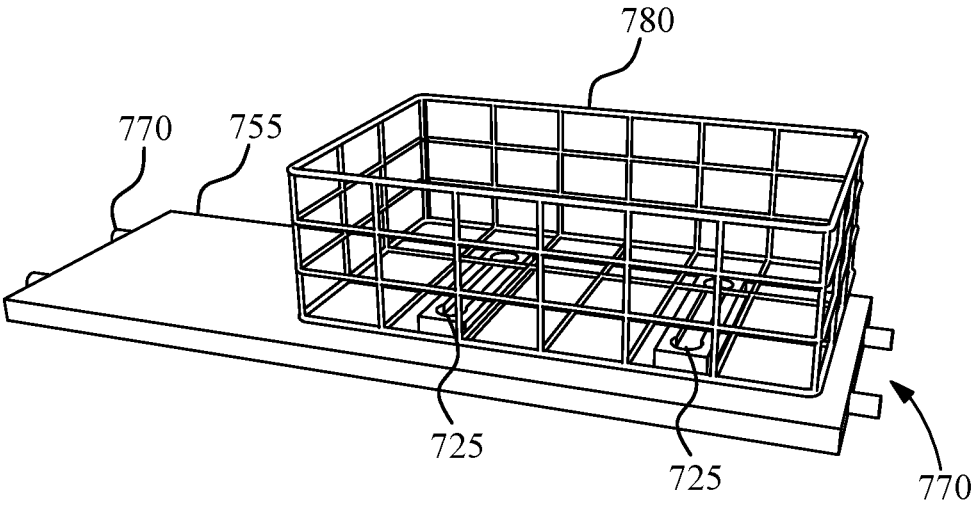
FIG. 7 is a perspective view of a wire basket attached to a shelf with slides.

FIG. 7 is a perspective view 700 of a wire basket 780 attached to shelf 755 with sleeves 710 having slides 725. Slide 725 allows the basket 780 to slide out/in. Shelf 755 can be fitted to a closet armoire via one or more springed pins 770 attached to shelf 755.

Figure 8:
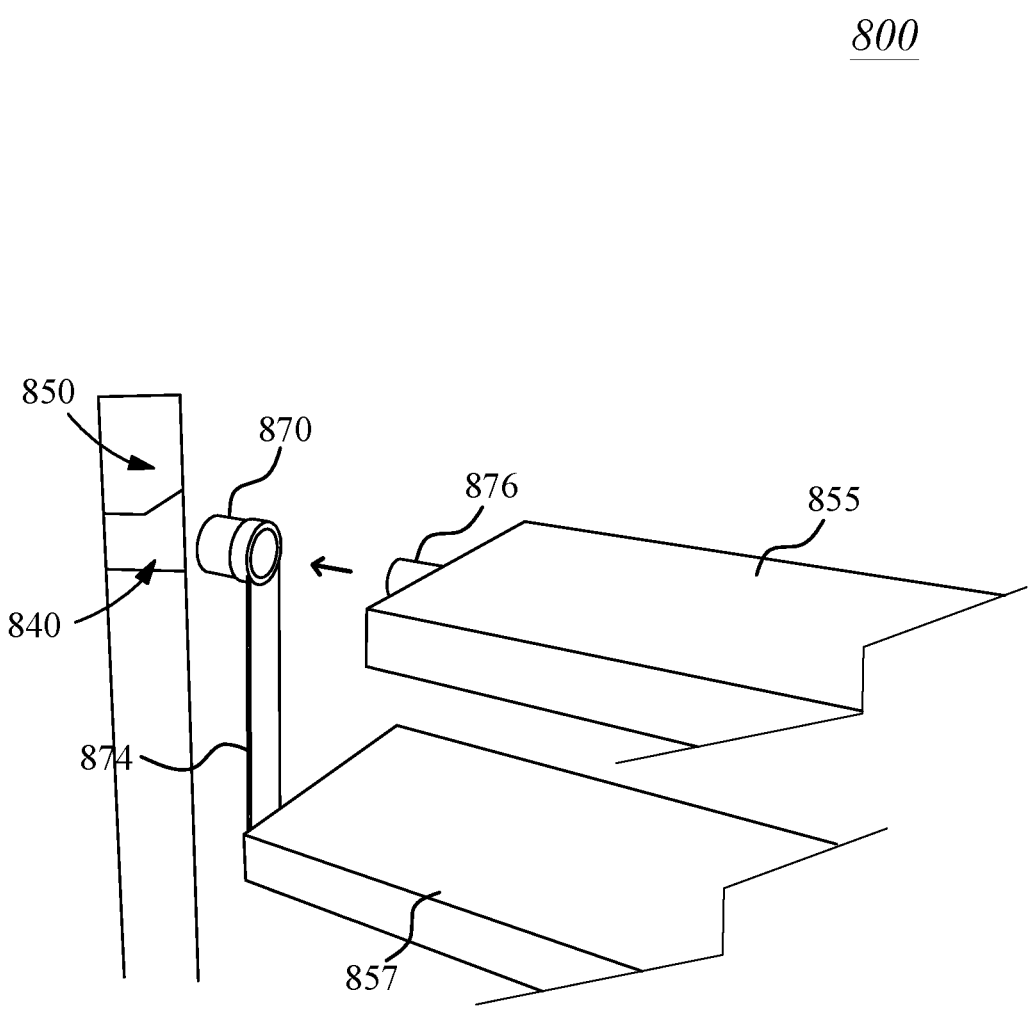
FIG. 8 is a cut-away view of closet armoire panel with tapered hole and perspective view of an associated hole hanger.

FIG. 8 is a cut-away view of panel 850 with tapered hole 840 and perspective view of an associated shelf-to-shelf (or other item) hole hanger 870 that is attached to lower shelf 857 via a lower arm 847. Hole hanger 870's upper portion is hollow to allow fitment of a springed pin 876 of shelf 855. The use of a hole hanger 870 with a hollow cylindrical head and lower arm 847 allows for a single hole 840 in a panel 850 to support multiple objects, shown here as two shelves 855 and 857. While only one hole hanger 870 is shown, multiple hole hangers 870 may be attached to their respective shelf or basket or other armoire feature. Further, in some embodiments the lower arm 847 may actually be an "upper" arm, according to design preference.

Figure 9:
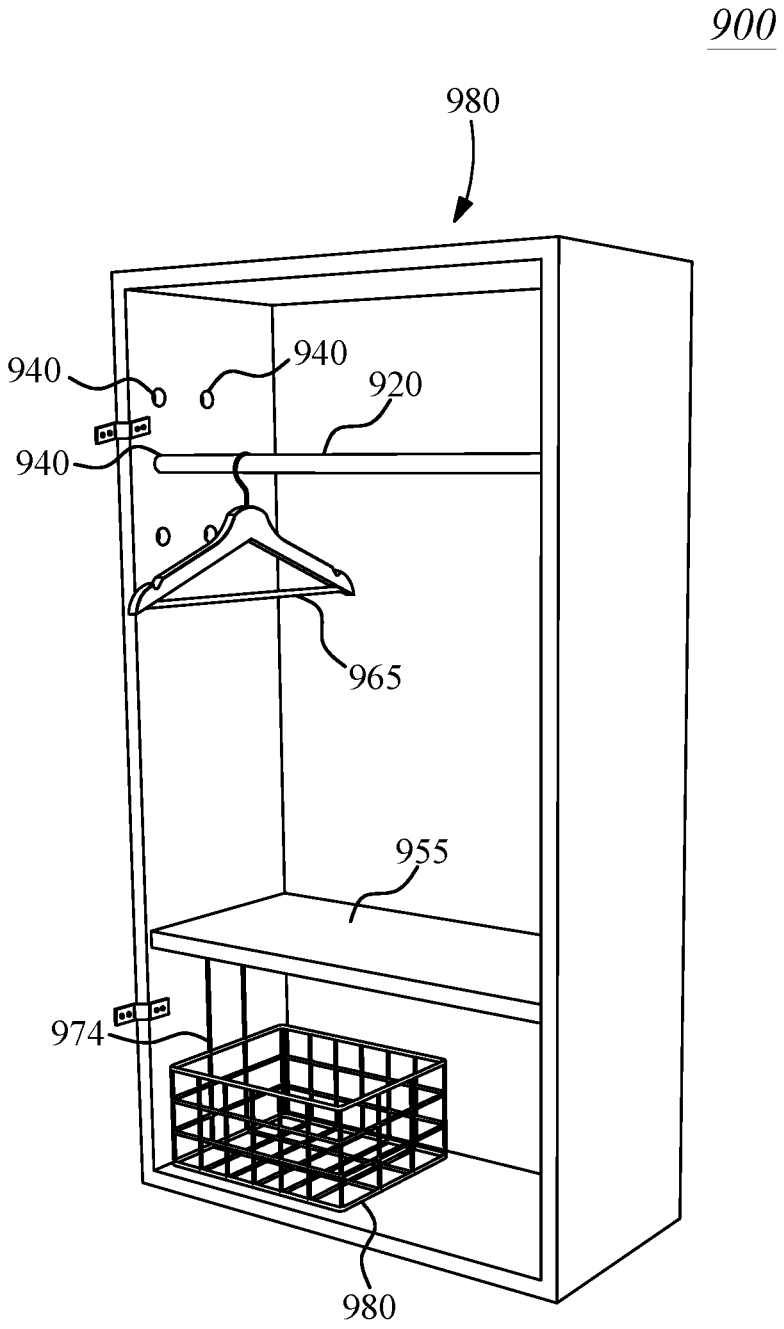
FIG. 9 is an interior view of closet armoire panel showing various arrangements.

FIG. 9 is an interior view 900 of panel 980 showing various arrangements. For example, holes 940 may be paired down the sides of panel 980 to allow customization of shelving, hanging rods, baskets, etc. Shown here is a rod 920 placed in the nearest hole 940, which is displaced furthest from the front (room facing side) of the panel 980. The rod 920 may or may not utilize a springed pin. This arrangement allows coat hanger 965 to partially protrude into the closet space (not shown), thus the lack of "thickness" of the panel 980 does not affect the ability to hang clothes in the closet armoire. Also shown is shelf 955 utilizing a hole hanger (not shown) with lower arm 974 that is attached to a basket 980. While FIG. 9 only shows a limited number of holes 940, more holes may used and the arrangement of the holes may vary with design preference.

Figure 10:
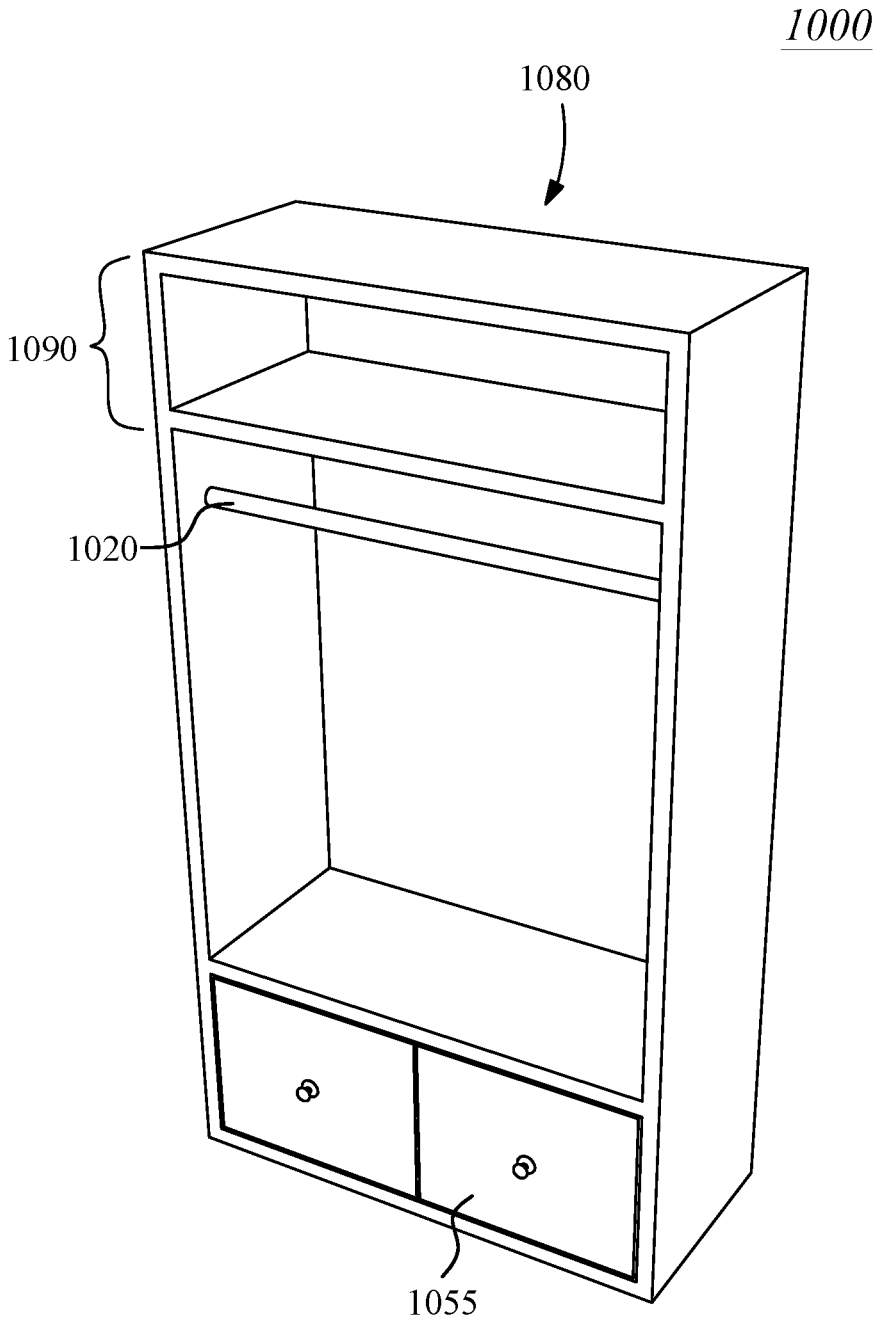
FIG. 10 is an interior perspective view of another embodiment of an exemplary closet armoire.

FIG. 10 is an interior perspective view 1000 of another embodiment of an exemplary closet armoire 1080. Here, the closet armoire 1080 has an upper storage area 1090, with clothes hanging rod 1020 (fixed or removable) containing drawers 1055. This embodiment illustrates the various options and capabilities of the exemplary closet armoire.

Figure 11A:
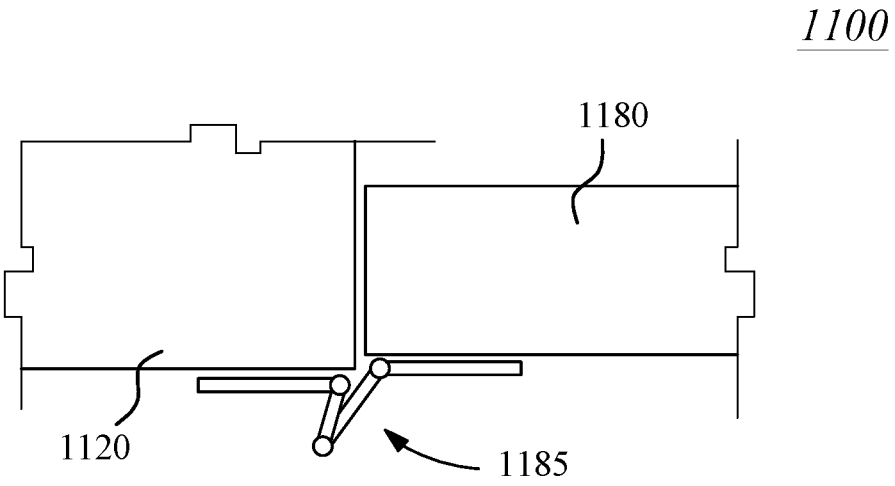
FIG. 11A is a top view of an exemplary 3-pivot hinging system.

FIG. 11A is a top view 1100 of an exemplary hinging system 1185 for attachment between a closet casing/side 1120 and a side of a closet armoire panel 1180. The exemplary 1185 is shown with multiple pivoting points and is illustrative of an multi-hinge. The forward section of the hinge 1185 is attached (via mounting holes—not shown) to a side of the panel 11880. The rear section of the hinge 1185 is attached (via mounting holes—not shown) to the door jam.

Figure 11B:
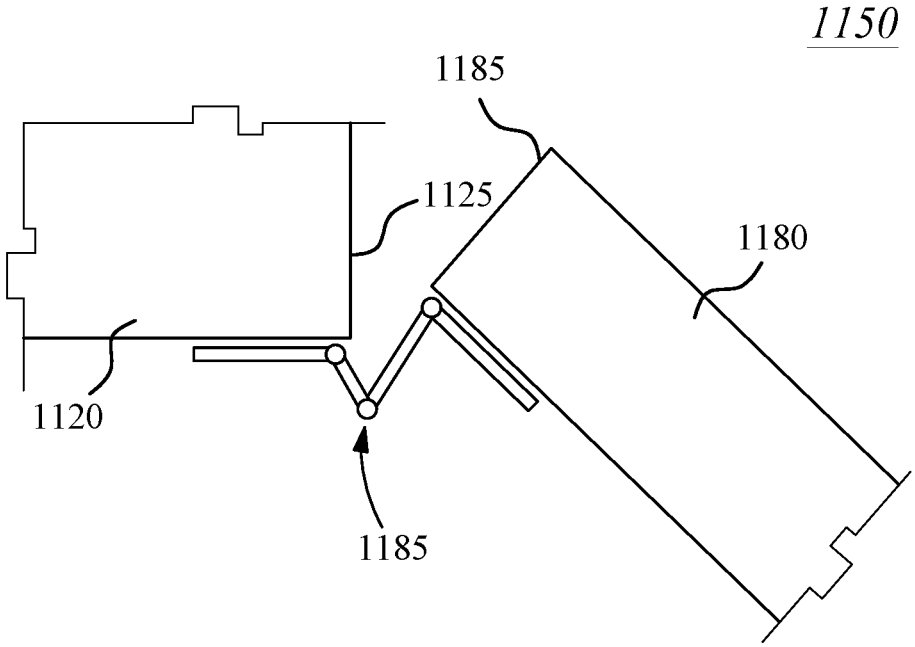
FIG. 11B is a top view of the exemplary hinging system of FIG. 11A, but in an opening position.

FIG. 11B is a top view 1150 of the exemplary hinging system 1185 of FIG. 11A, but in an opening position. Here, it is evident the multi-hinge aspect allows the back end 1185 of the panel 1180 to separate away and pivot from the front end of the closet casing 1125. This exemplary hinging system 1185 permits the closet armoire to close flush to the face closet casing 1125 and also allow it to open with sufficient clearance from the closet casing 1120 without pinching the face 1125. The embodiment of FIGS. 11A, B show a three-pivot hinge, but it should be appreciated that any design that allows the closet armoire to open and close may be used, as according to design preference.

Figure 12A:
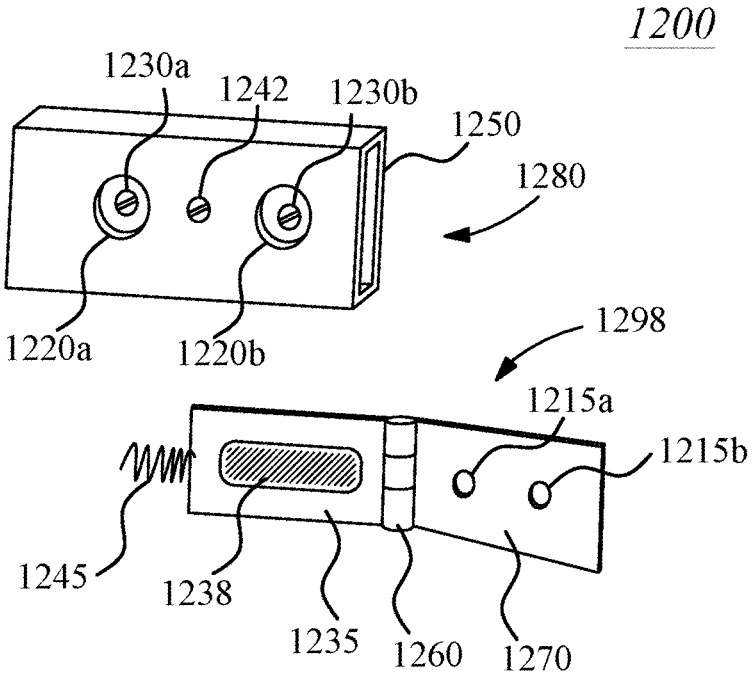
FIG. 12A is a perspective view illustration of slide-hinging system.

FIG. 12A is a perspective view illustration 1200 of another "hinging" system using a substantially rectangular hollow sleeve 1280 with interior sliding hinge 1298. Hollow sleeve 1280 has one or more access holes 1220*a,b* on one side for fitment of one or more screw(s) or nail(s) 1230*a,b* through coincident hole(s) (not shown) on the other side 1250 of hollow sleeve 1280. The screw(s)/nail(s) 1230*a,b* secure the other side 1250 of hollow sleeve 1280 to a closet casing (not shown). Stop pin or screw 1242 is removed at first and placed into the hollow sleeve 1280 after the sliding hinge 1298 is inserted into the hollow sleeve.

Sliding hinge 1298 has a closet side plate 1235 with substantially longitudinal gap 1238 therein, that is coupled to closet armoire side plate 1270 containing panel attachment hole(s) 1215*a,b*. Gap 1238 allows the sliding hinge 1298 to slide in and out of the hollow sleeve 1280, being constrained by stop pin 1242. Pivot 1260 joins the two plates of the sliding hinge 1298. An optional spring 1245 is attached to the end of closet side plate 1235 and/or is attached to an interior closet-side end of the hollow sleeve 1280. The spring 1245 operates to provide some measure of tension or compression on sliding hinge 1298, so as to assist in its movement. It should be understood that more than one pivot 1260 may be utilized, if so desired. Additionally, the arrangement, size of the holes, gaps, and fully enclosed nature of the hollow sleeve 1280 may be altered according to design preference. For example, the functionality of the hollow sleeve 1280 and accompanying sliding hinge 1298 may be accomplished by other means, which are within the scope and understanding of one of ordinary skill in the art.

Figure 12B:
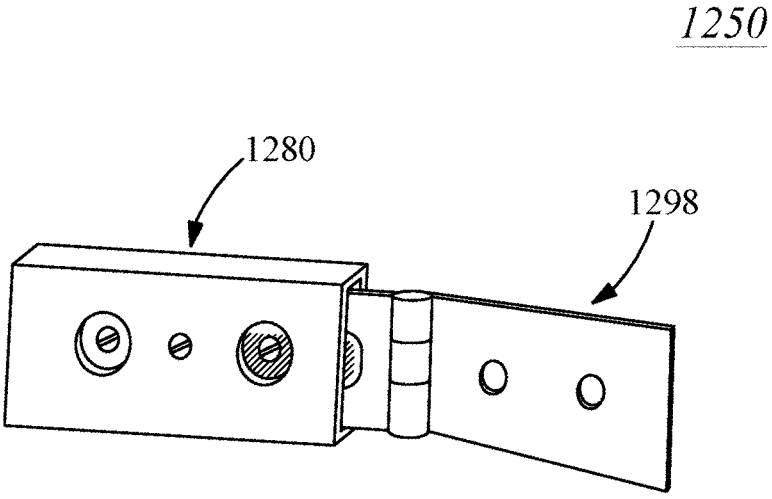
FIG. 12B is an illustration of the embodiment of FIG. 12A, but in an assembled configuration.

FIG. 12B is an illustration of the embodiment of FIG. 12A but in an assembled configuration, and is understood to be self-explanatory.

It should be appreciated that the above embodiments enable a person to expand their existing closet door with a "secondary" closet in the form of the described closet armoire, while maintaining privacy and ease of use. Such a system will provide a much needed different option to residents looking to increase their closet space, while desiring an attractive and easy-to install solution.

Various embodiments shown can be fabricated with a width that is less than a typical separately standing armoire or bureau. Because the exemplary system utilizes the existing closet space, it inherits the "walk-in" aspects found in most closets. Since the exemplary system is mounted to the closet casing or door jam, the system will not topple or fall over. With appropriate support for a given embodiment, the exemplary system can support up 250 lbs. Further, it is understood that if a light is provided inside the closet, the face of the closet armoire can be opened without casting light into the bedroom, thus reducing the possibility of waking another person sleeping in the room.

The present disclosure is not to be limited in terms of the particular embodiments described in this application, which are intended as illustrations of various aspects. Many modifications and variations can be made without departing from its scope, as will be apparent to those skilled in the art. It is also to be understood that the terminology used herein is for the purpose of describing particular embodiments only, and is not intended to be limiting, with the true scope being indicated by the following claims.

What is claimed is:

1. A system for increasing closet space by replacing an existing closet door with a closet armoire, the closet armoire comprising:

at least two adjacent armoire panels having associated depth, height and width, the panel depth(s) being at least six inches, the panel height(s) being greater than a height of a closet entrance, wherein the panels are jointly hinged at their junction so as to operate as a bi-fold or multi-fold door when the closet armoire is opened or closed;

a plurality of shelf mounting holes disposed on lateral sides of the panels;

at least one of a shelf and a hanging rod disposed on an interior closet-side of the panels;

track-free rollers attached to a bottom portion of at least one panel of the two adjacent armoire panels, supporting and permitting rolling of the closet armoire from a face of the closet entrance;

at least one of a handle and gripping area disposed on a front face of the closet armoire; and a plurality of armoire-to-closet door jam hinges attached to an interior side of the closet armoire and to closet door hinge holes on a door jam side of the closet entrance, wherein the width and height of the closet armoire is wider and taller than a casing of the closet doorway so as to cover the closet entrance when in a closed position, wherein an entirety of the closet armoire is disposed exterior to a surface plane formed by a front face of the closet casing, and wherein support and movement of the panels is solely via the joint hinges, track-free rollers and armoire-to-closet door jam hinges.

2. The closet armoire of claim 1, wherein a height of the closet armoire extends beyond the height of the closet entrance, and wherein a storage area is disposed in the extended portion of the closet armoire.

3. The closet armoire of claim 1, further comprising shelving disposed on the front face of the at least one panel.

4. The closet armoire of claim 1, wherein the hinges are at least triple-hinged, comprising:

a rear portion with mounting holes for attaching the rear portion to the door jam, a forward portion with mounting holes for attaching the forward portion to the panel, and a non-attached mid-portion, wherein multiple hinging operates to permit a rear edge of the panel, attached to the door jam, to move away from the door jam without pinching the door jam, when the panel is pulled open.

5. The closet armoire of claim 1, wherein the hinges are a combination sliding-pivoting hinge, comprising:

a substantially rectangular, hinge-holding, hollow sleeve with a panel-side opening and at least two mounting holes through opposing lateral sides of the sleeve and a retaining hole through one of the opposing lateral sides of the sleeve, wherein the mounting holes enable door jam screws to be mounted therein to retain the hollow sleeve to the door jam and the retaining hole enables a removable retaining pin or screw to be fixed therein; and a hinge with a forward portion with mounting holes for attachment to the panel and a rear portion with a substantially longitudinal opening accommodating placement of the door jam screws therein, wherein placement of the rear portion of the hinge into the hollow sleeve and with insertion of the removable retaining pin or screw into the retaining hole, permits limited sliding of the hinge into and out of the hollow sleeve.

6. The closet armoire of claim 5, further comprising a spring, wherein the spring is attached to a closet-side end of the rear portion of the hinge and to a closet-side end of the hollow sleeve.

7. The closet armoire of claim 1, further comprising at least one of a sliding basket and drawer disposed on the shelf within the at least one panel.

8. The closet armoire of claim 7, wherein the at least one shelf and sliding basket further comprises springed mounting protrusions at ends thereof for insertion into the shelf mounting holes.

9. The closet armoire of claim 1, further comprising modified shelving holes in sides of the at least one panel, wherein the modified shelving holes are shaped with an interior upper surface that opens upwardly and to a face of the hole, so as to allow a mounting protrusion from a shelf or basket to slide into and be pushed down to a terminal point of the modified shelving holes.

10. The closet armoire of claim 1, further comprising a shelf-to-shelf mounting hole member, comprising:

a substantially cylindrical insert with a hollow end, configured to fit into a shelf mounting hole;

an extension arm, one end coupled to at least one of an upper and lower portion of the insert; and at least one of a shelf, drawer, rod, and basket coupled to an other end of the extension arm, wherein the hollow end of the insert is sized to accommodate a mounting protrusion for another shelf, drawer, rod, or basket, wherein the shelf-to-shelf mounting hole member permits a single shelf mounting hole to support a plurality of shelves, drawers, rods, or baskets.

11. The closet armoire of claim 1, further comprising a door on a face of the at least one panel, the door providing access to items stored within a panel.

* * * * *